US010276082B2

(12) United States Patent
Iwafuchi et al.

(10) Patent No.: US 10,276,082 B2
(45) Date of Patent: Apr. 30, 2019

(54) COLOR ADJUSTMENT DEVICE, COLOR PROCESSING METHOD, AND STORAGE MEDIUM

(71) Applicant: FUJI XEROX CO., LTD., Tokyo (JP)

(72) Inventors: Toshihiro Iwafuchi, Kanagawa (JP); Noriko Sakai, Kanagawa (JP); Makoto Fujio, Kanagawa (JP); Masashi Morimoto, Kanagawa (JP); Yusuke Izumisawa, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/890,891

(22) Filed: Feb. 7, 2018

(65) Prior Publication Data

US 2018/0366049 A1 Dec. 20, 2018

(30) Foreign Application Priority Data

Jun. 20, 2017 (JP) ..... 2017-120755

(51) Int. Cl.
*G09G 3/20* (2006.01)
*G09G 3/36* (2006.01)

(52) U.S. Cl.
CPC ..... *G09G 3/2003* (2013.01); *G09G 3/36* (2013.01); *G09G 2320/0666* (2013.01); *G09G 2360/145* (2013.01)

(58) Field of Classification Search
None
See application file for complete search history.

(56) References Cited

U.S. PATENT DOCUMENTS

2010/0026702 A1* 2/2010 Herbert ..... G09G 5/02 345/589
2014/0368530 A1* 12/2014 James ..... G06Q 30/0643 345/593

FOREIGN PATENT DOCUMENTS

JP 2006-231863 A 9/2006
JP 2014-014056 A 1/2014

* cited by examiner

*Primary Examiner* — Peter Hoang
(74) *Attorney, Agent, or Firm* — Sughrue Mion, PLLC

(57) ABSTRACT

A color adjustment device includes an environment information acquisition unit that acquires information on an environment of when an object that is displayed as an image by a display device is viewed in an actual use state; and a determination unit that determines a color temperature and a luminance of the display device on the basis of the information on the environment and information on a type of the object.

8 Claims, 10 Drawing Sheets

FIG. 4A

EDIT OF BASIC INFORMATION

INDUSTRY

PRINT COMPANY ▽

RESULTANT

WEB DESIGN ▽

OK CANCEL

FIG. 4B

REGISTRATION OF DISPLAY INFORMATION

DEVICE TYPE *REQUIRED

DISPLAY ▽

MANUFACTURER

ZZZZ

MODEL NUMBER *REQUIRED

24YY

SCREEN SIZE *REQUIRED

SMALLER THAN 25 INCHES

OK CANCEL

FIG. 5A

| INDUSTRY/ RESULTANT TYPE | PRINT COMPANY | | | PRODUCT DESIGNER | | | ADVERTISING AGENT | | |
|---|---|---|---|---|---|---|---|---|---|
| | PRINTED MATTER | WEB DESIGN | SIGNAGE | PRINTED MATTER | WEB DESIGN | SIGNAGE | PRINTED MATTER | WEB DESIGN | SIGNAGE |
| COLOR TEMPERATURE | 5000 | 5500 | 6000 | 5000 | 5500 | 6000 | 5000 | 5500 | 6000 |

FIG. 5B

| DEVICE TYPE/ SCREEN SIZE | DISPLAY | | | | PROJECTOR | |
|---|---|---|---|---|---|---|
| | SMALLER THAN 25 INCHES | 25 (INCLUSIVE) TO 42 (EXCLUSIVE) INCHES | 42 (INCLUSIVE) TO 70 (EXCLUSIVE) INCHES | 70 INCHES OR LARGER | SMALLER THAN 42 INCHES | 42 INCHES OR LARGER |
| LUMINANCE | 100 | 150 | 200 | USE MAX | 180 | USE MAX |

FIG. 6A

| INDUSTRY/ RESULTANT TYPE | PRINT COMPANY | | | PRODUCT DESIGNER | | | ADVERTISING AGENT | | |
|---|---|---|---|---|---|---|---|---|---|
| | PRINTED MATTER | WEB DESIGN | SIGNAGE | PRINTED MATTER | WEB DESIGN | SIGNAGE | PRINTED MATTER | WEB DESIGN | SIGNAGE |
| INTENT | Rel | Per | Sat | Rel | Per | Sat | Rel | Per | Sat |

FIG. 6B

| DEVICE TYPE | PRINTED MATTER | WEB DESIGN | SIGNAGE |
|---|---|---|---|
| ELECTROPHOTOGRAPHIC SYSTEM | Rel | Per | Sat |
| INKJET SYSTEM | Rel | Rel | Rel |

FIG. 9

CREATION OF PROFILE

FILE (F) TOOL (T) HELP (H)

TARGET FILE zzzzzzzzzzz.target

REFERENCE (O)... EDIT CREATION CONDITION (D)...

ENVIRONMENT INFORMATION

ENVIRONMENT NAME: aaaaaaaaaa

SELECT MODEL (S): bbbbbbbbb

TYPE: DISPLAY

MANUFACTURER: xxxxxxxxxxx

SCREEN SIZE: SMALLER THAN 25 INCHES

OUTPUT PROFILE NAME (F):

yyyyyyyyyyy

BACK (B) NEXT (N) CANCEL (X)

COLOR ADJUSTMENT DEVICE, COLOR PROCESSING METHOD, AND STORAGE MEDIUM

CROSS-REFERENCE TO RELATED APPLICATIONS

This application is based on and claims priority under 35 USC 119 from Japanese Patent Application No. 2017-120755 filed Jun. 20, 2017.

BACKGROUND

(i) Technical Field

The present invention relates to a color adjustment device, a color processing method, and a storage medium.

(ii) Related Art

In recent years, products are designed more frequently by using computer devices such as personal computers (PCs) and computer graphics (CG). In this case, a designer designs a product by outputting an image of the product to a display device such as a liquid crystal display connected to a PC or the like.

SUMMARY

According to an aspect of the invention, there is provided a color adjustment device including an environment information acquisition unit that acquires information on an environment of when an object that is displayed as an image by a display device is viewed in an actual use state; and a determination unit that determines a color temperature and a luminance of the display device on the basis of the information on the environment and information on a type of the object.

BRIEF DESCRIPTION OF THE DRAWINGS

An exemplary embodiment of the present invention will be described in detail based on the following figures, wherein:

FIGS. 4A and 4B illustrate windows that are displayed on a display screen of a display device when a user inputs precondition information;

FIGS. 5A and 5B each illustrate a method of determining a color temperature and a luminance on the basis of the precondition information;

FIG. 6A illustrates a method of determining intent of an image that is displayed by the display device, and FIG. 6B illustrates a method of determining intent of an image that is printed by a printer;

FIG. 9 illustrates a window that is displayed on the display screen of the display device when a conversion relation is created.

DETAILED DESCRIPTION

An exemplary embodiment of the present invention is described below in detail with reference to the accompanying drawings.

Description on Entire Color Processing System

Figure 1:
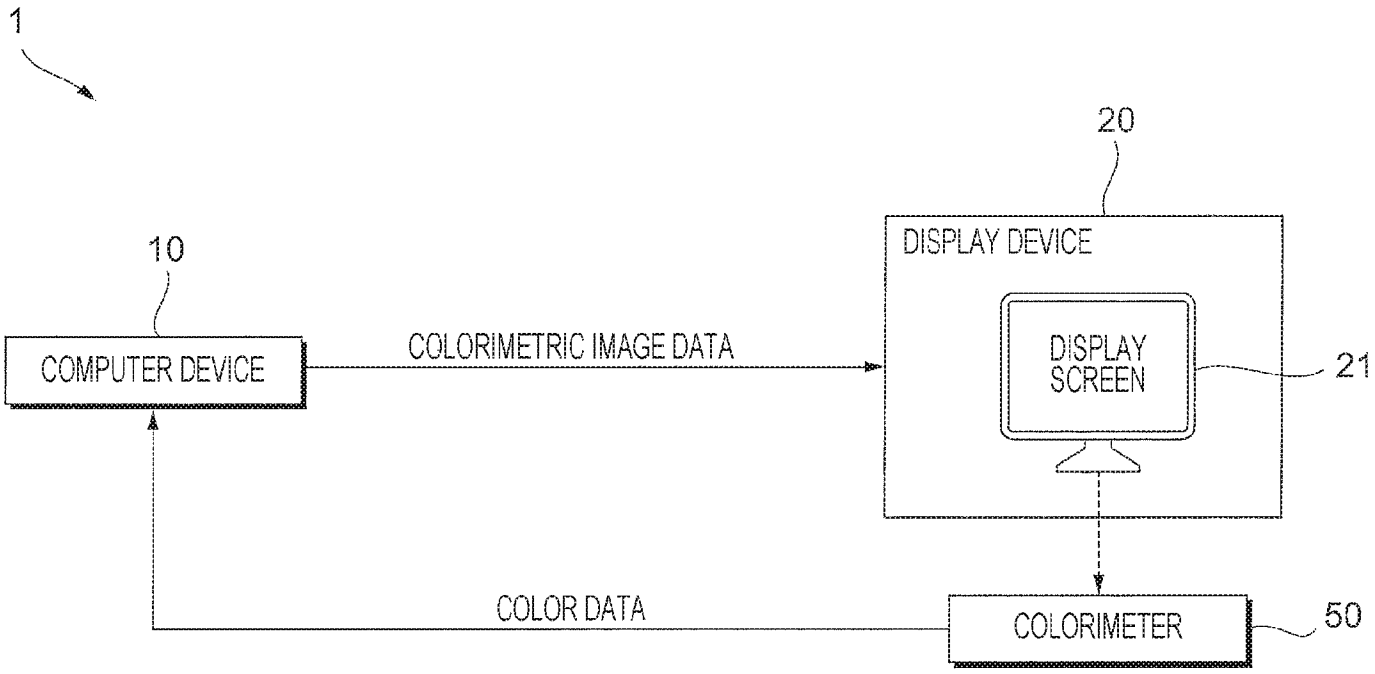
FIG. 1 illustrates an example configuration of a color processing system to which an exemplary embodiment is applied.

FIG. 1 illustrates an example configuration of a color processing system 1 to which the exemplary embodiment is applied. The color processing system 1 includes a computer device 10 that, for example, creates image data (image information, input color signal), and a display device 20 that displays an image on the basis of the image data.

In this color processing system 1, the computer device 10 and the display device 20 are connected to each other via, for example, a digital visual interface (DVI). Alternatively, the connection may be made via High-Definition Multimedia Interface (HDMI, registered trademark) or DisplayPort instead of DVI.

The computer device 10 is a so-called general-purpose personal computer (PC). The computer device 10, for example, creates image data by activating various application software under management of an operating system (OS). The computer device 10 may include, for example as an input device, a keyboard, a mouse, and so forth (not illustrated).

Figure 2:
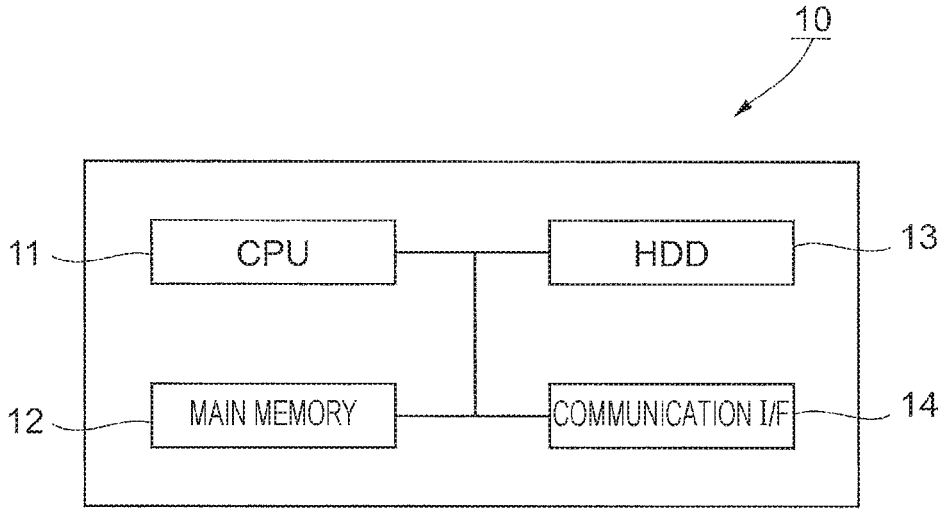
FIG. 2 illustrates a hardware configuration of a computer device.

FIG. 2 illustrates a hardware configuration of the computer device 10. The computer device 10 is implemented by the personal computer or the like as described above. The computer device 10 includes a central processing unit (CPU) 11 serving as a calculation unit, a main memory 12 serving as a memory, and a hard disk drive (HDD) 13 as illustrated in FIG. 2. The CPU 11 executes various programs such as the operating system (OS) and application software. The main memory 12 is a storage area that stores the various programs and data used for executing the various programs. The HDD 13 is a storage area that stores input data to the various programs and output data from the various programs. The computer device 10 also includes a communication interface (hereinafter, referred to as "communication I/F") 14 for communicating with an external device including the display device 20.

The display device 20 displays an image on the basis of image data. The display device 20 is a configuration having a function of displaying an image by additive color mixture, such as a liquid crystal display for PC, a liquid crystal television system, or a projector. Hence, the display system of the display device 20 is not limited to the liquid crystal system. In the exemplary embodiment, it is assumed that the display device 20 displays an image by using three colors of red (R), green (G), and blue (B). Since FIG. 1 illustrates, for example, the case of using the liquid crystal display for PC as the display device 20, the display screen 21 is provided in the display device 20. If a projector is used as the display device 20, the display screen 21 is a screen or the like provided outside the display device 20.

FIG. 1 illustrates a colorimeter 50 that is used for reading an image displayed on the display screen 21 of the display device 20, together with the color processing system 1.

The colorimeter 50 includes a sensor (not illustrated) that reads an image according to the three colors of red (R), green (G), and blue (B). The colorimeter 50 may measure an image displayed on the display screen 21 by full-color measurement. In the example illustrated in FIG. 1, the colorimeter 50 and the computer device 10 are connected to each other via USB. Color data after measurement may be transmitted to the computer device 10. The colorimeter 50 is not particularly limited, and may use contact type or camera type.

For example, the color processing system 1 operates as follows. In the color processing system 1, the computer device 10 creates image data (colorimetric image data) for a colorimetric image. The computer device 10 transmits the image data to the display device 20, and causes the display screen 21 of the display device 20 to display a colorimetric image based on the colorimetric image data. The colorimeter 50 reads the colorimetric image displayed on the display screen 21, and acquires color data. The computer device 10 creates a conversion relation for correcting image data that is output to the display device 20 on the basis of the color data. Although the details will be described later, the conversion relation is for performing color adjustment on an image that is displayed on the display screen 21 of the display device 20, matching the coloring of an image of a resultant (object) that is displayed on the display screen 21 with the coloring of the actual resultant, and thus reproducing the coloring. In this case, the display device 20 functions as an example of a display device that displays an image of an object.

In this case, a resultant (object) is an object subjected to reproduction of coloring by the display device 20. The resultant includes a matter that is displayed on a screen, and a real matter. In the case of the matter that is displayed on a screen, image data that is used when displayed on a display device such as a display serves as a resultant. To be specific, for example, the image data may be CG data, Web design, or signage (advertisement or guide indication using imaging device). The display device is different from the display device 20, and may be hereinafter occasionally referred to as "another display device." That is, in this case, to reproduce the coloring of an image when image data (resultant), such as CG data, Web design, or signage, is displayed by another display device, the coloring of an image that is displayed by the display device 20 is adjusted in accordance with the coloring of the image that is displayed by another display device. Hence the computer device 10 functions as a color adjustment device that performs color adjustment on an image that is displayed by the display device 20.

In a case where an image is output to and printed on a recording medium such as paper by using a printer or the like, the printed matter (real matter) serves as a resultant. In a case where a matter is formed by using a three-dimensional (3D) printer, the formed matter (real matter) serves as a resultant. In a case where an image that is displayed on the display screen 21 of the display device 20 is an image of an automobile, the automobile (real matter) serves as a resultant.

The computer device 10 that realizes the color adjustment function is described below.

Description on Computer Device 10

Figure 3:
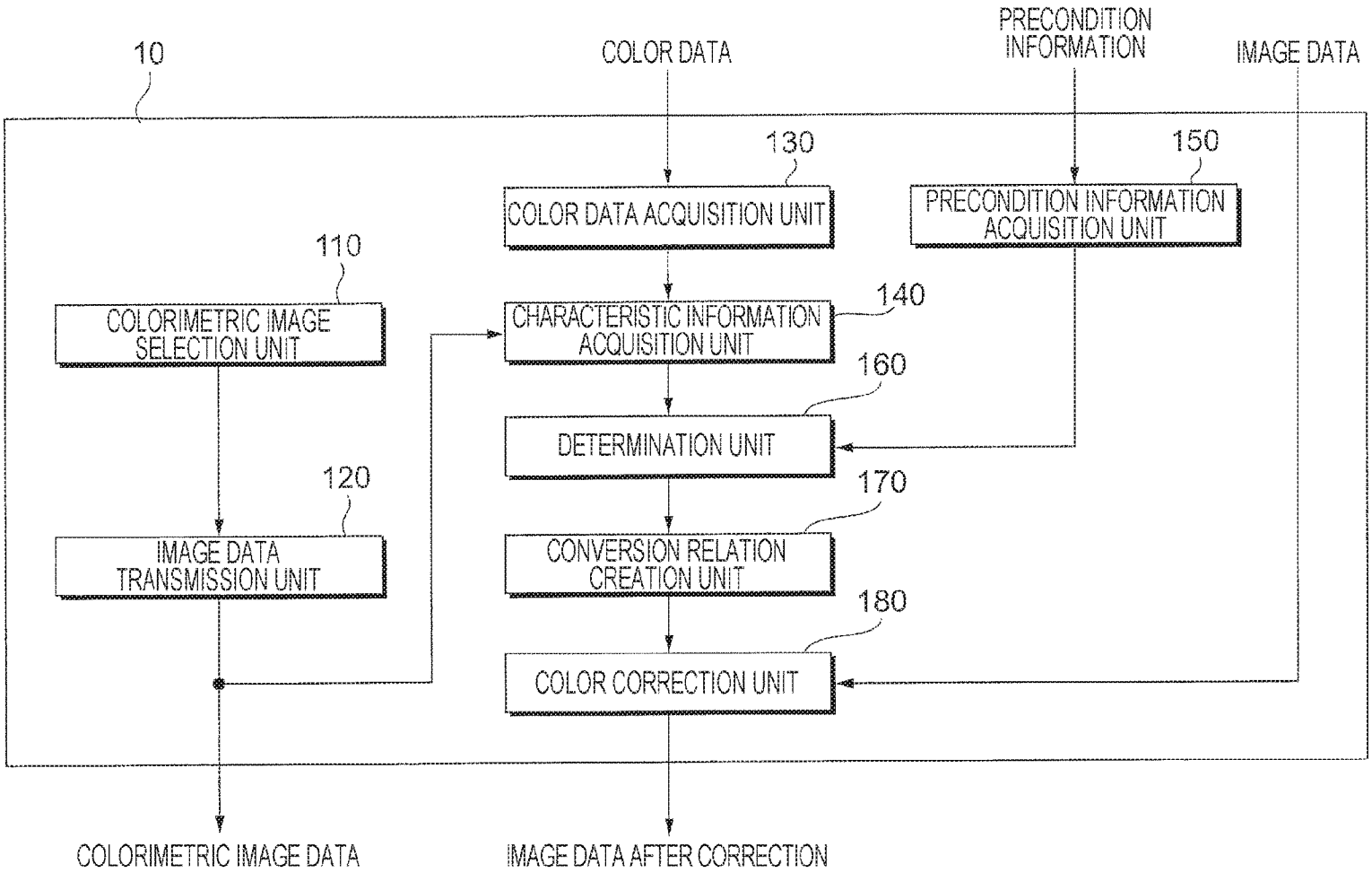
FIG. 3 is a block diagram illustrating a functional configuration example of the computer device according to the exemplary embodiment.

FIG. 3 is a block diagram illustrating a functional configuration example of the computer device 10 according to the exemplary embodiment. The illustrated computer device 10 includes a colorimetric image selection unit 110, an image data transmission unit 120, a color data acquisition unit 130, a characteristic information acquisition unit 140, a precondition information acquisition unit 150, a determination unit 160, a conversion relation creation unit 170, and a color correction unit 180.

The colorimetric image selection unit 110 selects the above-described colorimetric image. The colorimetric image includes, for example, rectangular images having different color characteristics, such as hues and color saturation.

The image data transmission unit 120 outputs colorimetric image data, which is image data of the colorimetric images selected by the colorimetric image selection unit 110, to the display device 20 to perform color adjustment of the display device 20. The colorimetric image data is output as RGB data being color signals of R, G, and B in an RGB color space. In this exemplary embodiment, the RGB data is expressed by 8 bits (256-level tone of 0 to 255) for each of color values of R, G, and B.

The colorimetric images are sequentially displayed on the display screen 21 of the display device 20 on the basis of the colorimetric image data transmitted from the image data transmission unit 120. The colors of the colorimetric images displayed on the display screen 21 are read by the colorimeter 50.

The colorimeter 50 transmits color information (color data) acquired by reading the colorimetric images to the computer device 10. The color data output from the colorimeter 50 at this time is, for example, color values of X, Y, and Z in an XYZ color space. Alternatively, the color data may be color data obtained by converting the color data acquired by reading the colorimetric images into color data in another color space (for example, L*a*b* data in L*a*b* color space).

The color data acquisition unit 130 acquires the color data transmitted from the colorimeter 50.

The characteristic information acquisition unit 140 acquires device characteristic information indicative of a relation between an input color signal to the display device 20 and a color to be displayed. That is, in this case, the relation between the colorimetric image data being the input color signals and the color data being the colors to be displayed serves as device characteristic information. Hence the device characteristic information is configured of a pair of RGB data and XYZ data ((R, G, B)-(X, Y, Z)).

The precondition information acquisition unit 150 is an example of an environment information acquisition unit. The precondition information acquisition unit 150 acquires information on an environment of when a resultant (object) that is displayed as an image by the display device 20 is viewed in an actual use state. Also, the precondition information acquisition unit 150 acquires information on a type of resultant in addition to the information on the environment. Hereinafter, the information on the environment and the information on the type of resultant are occasionally collectively referred to as precondition information. The precondition information will be described later.

The determination unit 160 determines a color temperature and a luminance of an image that is displayed by the display device 20 on the basis of the information on the environment and the information on the type of resultant to perform color adjustment for reproducing the color of the resultant by the display device 20. The method of determining the color temperature and luminance on the basis of the information on the environment and the information on the type of resultant will be described later.

The conversion relation creation unit 170 creates a conversion relation for performing color adjustment on the basis of the device characteristic information and the determined color temperature and luminance. Although the details will be described later, if the determination unit 160 further determines an expression trend (intent) in addition to the color temperature and luminance of the image that is displayed by the display device 20, the conversion relation creation unit 170 creates the conversion relation by using the expression trend (intent) in addition to the device characteristic information, color temperature, and luminance.

The conversion relation for performing color adjustment is also called profile, and may be created as, for example, three-dimensional look up table (LUT). That is, when it is assumed that RGB data before correction is ($R_a$, $G_a$, $B_a$), and RGB data after correction is ($R_b$, $G_b$, $B_b$), a LUT for ($R_a$, $G_a$, $B_a$)→($R_b$, $G_b$, $B_b$) is created. The method of creating the LUT will be described later. However, the conversion relation is not limited thereto. For example, the conversion relation may be a one-dimensional LUT of $R_a \rightarrow R_b$, $G_a \rightarrow G_b$, $B_a \rightarrow B_b$. Alternatively, correction of $R_a \rightarrow R_b$, $G_a \rightarrow G_b$, $B_a \rightarrow B_b$ may be performed by gamma conversion.

The color correction unit 180 corrects the image data that is output to the display device 20 by using the conversion relation created by the conversion relation creation unit 170. Then the color correction unit 180 transmits the image data after correction to the display device 20.

Description on Precondition Information

The precondition information that is acquired by the precondition information acquisition unit 150 is described next. The precondition information includes the information on the type of resultant and the information on the environment of when the resultant is viewed. The information on the type of resultant (object) is information about a resultant, and the resultant is an object subjected to reproduction of coloring by the display device 20 as described above. That is, the resultant is image data (CG data, Web design, signage, etc.) that is used when displayed by a display device such as a display, a printed matter, or the like.

Also, the information on the environment includes information on an industry relating to the resultant (object). The information on the environment includes information on a model to which the resultant (object) is output as an image. The information on the environment may include information on an illumination environment of when the resultant (object) is viewed in an actual use state.

The information on the industry is information on an industry where the resultant (object) is actually used. For example, the information is about print company, product designer, advertising agent, etc.

The information on the model is individual information on a display device such as a display that displays the resultant, or a device such as a printer. The information on the model includes, for example, a type of device (display, projector, printer, etc.).

When the type of device is a display device (another display device) such as a display or a projector, for example, the information on the model includes the name of manufacturer, model number, and screen size. That is, in this case, the information on the model includes information on the model of another display device that displays the image data (CG data, Web design, signage, etc.) being the resultant as an image.

Further, if the type of device is a printer, the information on the model includes the name of manufacturer, model number, print system (electrophotographic system, inkjet system, etc.), and the type of paper for printing.

Also, the information on the illumination environment is, for example, information about outdoor/indoor, the type of illumination, color temperature of illumination, luminance of illumination, and presence of ultraviolet light.

The precondition information is, for example, input to the computer device 10 by a user. FIGS. 4A and 4B illustrate windows that are displayed on the display screen 21 of the display device 20 when the user inputs precondition information. FIG. 4A illustrates a window when the industry and the type of resultant are input. These may be input by selecting items from pull-down menus. FIG. 4B illustrates a window when the information on the model is input. The type of device may be input by selecting an item from a pull-down menu. Also, the name of manufacturer, model number, and screen size may be input.

Description on Method of Determining Color Temperature and Luminance Based on Precondition Information The method of determining the color temperature and luminance on the basis of the precondition information by the determination unit 160 is described next. FIGS. 5A and 5B each illustrate a method of determining the color temperature and luminance on the basis of the precondition information. In this exemplary embodiment, as illustrated in FIG. 5A, the determination unit 160 determines the color temperature by using the information on the industry relating to the resultant and the information on the type of resultant (object) included in the precondition information. For example, if the industry that uses the resultant is a print company and the type of resultant is Web design, the color temperature of an image that is displayed by the display device 20 is set at 5500 K. Also, in this exemplary embodiment, as illustrated in FIG. 5B, the determination unit 160 determines the luminance by using the information on the model of another display device included in the precondition information. For example, if the type of device is a display and the screen size is smaller than 25 inches, the luminance of an image that is displayed by the display device 20 is set at 100.

At this time, the determination unit 160 may further determine an expression trend (intent) of an image that is displayed by the display device 20. FIG. 6A illustrates a method of determining intent of an image that is displayed by the display device 20. In this exemplary embodiment, the intent is determined by using the information on the industry and the information on the type of resultant. In this case, three types of Rel, Per, and Sat serve as determination results. Regarding the contents, Rel is prepared as "relative colorimetric (emphasized on color match in terms of colorimetry)." Per is prepared as "perceptual (emphasized on color match in terms of tone)." Sat is prepared as "saturation (emphasized on colorfulness)."

FIG. 6B illustrates a method of determining intent of an image that is printed by a printer. In this exemplary embodiment, the intent is determined by using the print system (electrophotographic system, inkjet system) being the information on the model, and the information on the type of resultant. Also in this case, three types of Rel, Per, and Sat serve as determination results.

The relations illustrated in FIGS. 5A to 6B each may be stored as a file, and may be stored in a memory until the conversion relation creation unit 170 creates the conversion relation.

Figure 7:
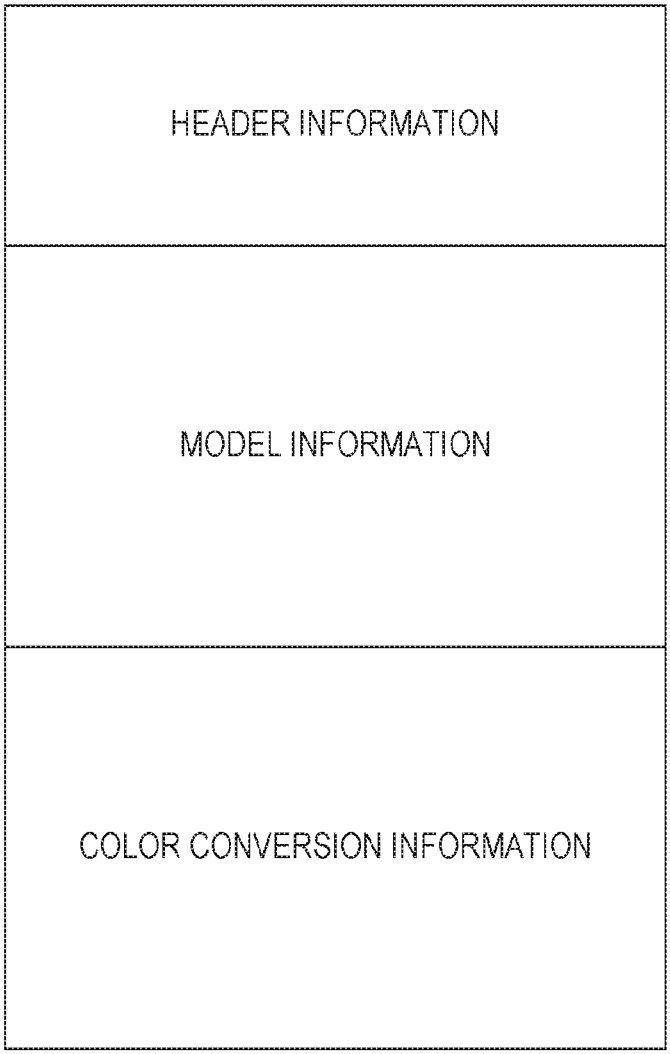
FIG. 7 illustrates a data structure when the relations illustrated in FIGS. 5A to 6B each are stored as a file.

FIG. 7 illustrates a data structure when the relations illustrated in FIGS. 5A to 6B each are stored as a file. The illustrated data structure includes three pieces of information including header information, model information, and color conversion information. The model information is individual information on a device as described above, and includes the type of device, name of manufacturer, model number, screen size, print system, and type of paper for printing. In this case, the model information includes information on plural models. Also, the header information is information not dependent on the device, and is information common to the plural models. For example, the header information includes the above-described information on the industry and the information on the illumination environment. Further, the color conversion information includes the color temperature, luminance, and intent determined by the determination unit 160.

Description on Method of Creating Conversion Relation

A method of creating the conversion relation by the conversion relation creation unit 170 is described next.

The conversion relation creation unit 170 sets respective values of X, Y, and Z (in this case, referred to as Xs, Ys, Zs) according to the color temperature determined by the determination unit 160. To be specific, the Xs value and Zs value are uniquely determined according to the color temperature. If the color temperature is 6500 K, for example, the Xs value and Zs value are determined as (Xs, Zs)=(95, 85). Also, it is assumed that Ys (luminance) is a luminance determined by the determination unit 160. In this case, it is assumed that Ys=100 (100 cd/$m^2$).

Then, the conversion relation creation unit 170 converts respective values of Xs, Ys, and Zs into respective values of R, G, and B on the basis of the device characteristic information acquired by the characteristic information acquisition unit 140, by using linear regression model, multiple regression analysis, and prediction calculation of neural model. That is, the respective values of R, G, and B obtained by converting the respective values of Xs, Ys, and Zs by using the device characteristic information serve as input color signals when a white image is displayed by the display device 20 at the color temperature determined by the determination unit 160. In this exemplary embodiment, R, G, and B after conversion are referred to as Rs, Gs, and Bs. In this case, it is assumed that values obtained by converting (Xs, Ys, Zs)=(95, 100, 85) by using the device characteristic information are (Rs, Gs, Bs)=(170, 159, 143).

Then the conversion relation creation unit 170 creates correction RGBLUT for correcting ($R_a$, $G_a$, $B_a$) being RGB data before correction. The correction RGBLUT is a one-dimensional LUT for correcting $R_a$, $G_a$, $B_a$ while the correction RGB values (Rs, Gs, Bs) serve as maximum values.

Figure 8:
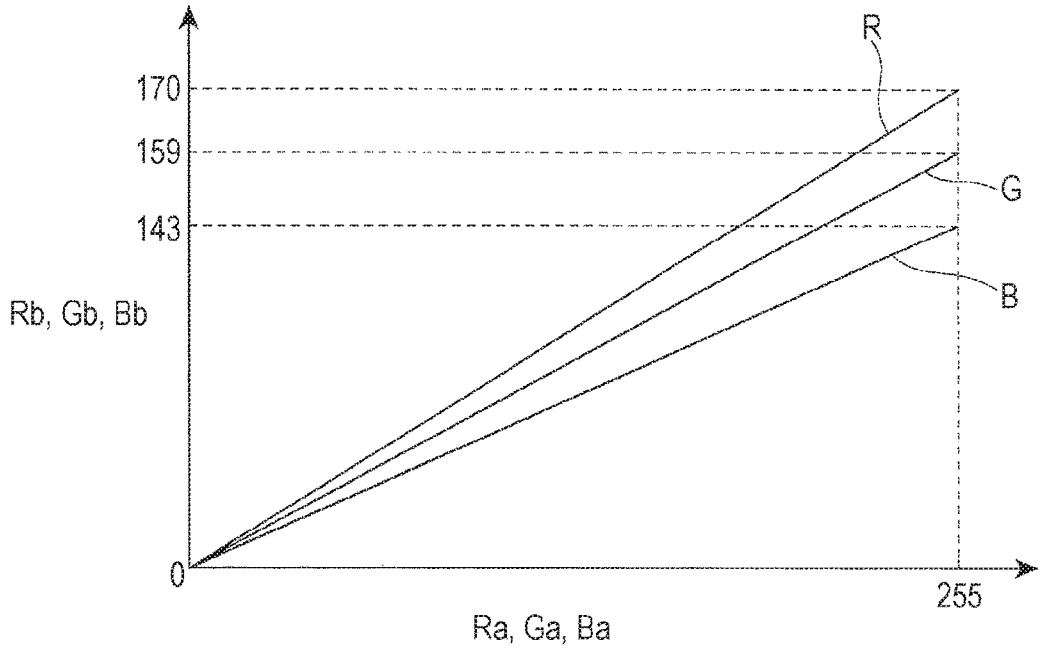
FIG. 8 is a graph plotting corrected RGBLUT.

FIG. 8 is a graph illustrating the correction RGBLUT when (Rs, Gs, Bs)=(170, 159, 143). The illustrated one-dimensional LUT connects 0 to 170 by a line for red (R) signal, connects 0 to 159 by a line for green (G) signal, and connects 0 to 143 for blue (B) signal. Each connection is not limited to the line, and may be a curve, such as a quadric curve or a cubic curve. With the one-dimensional LUT set as described above, ($R_a$, $G_a$, $B_a$) being RGB data before correction having the maximum value of 255 may be converted into ($R_b$, $G_b$, $B_b$) being RGB data after correction having the maximum values (Rs, Gs, Bs)=(170, 159, 143).

FIG. 9 illustrates a window that is displayed on the display screen 21 of the display device 20 when a conversion relation is created. In the drawing, the target file represents the file described with reference to FIG. 8, and the information on the environment is displayed. In this case, the type of device is a display, and further the manufacturer name and screen size are displayed. Also, the file name of the profile being the conversion relation may be input from the output profile name. In this state, if "NEXT" is selected, the conversion relation (profile) is created.

Description on Operation of Computer Device 10

Figure 10:
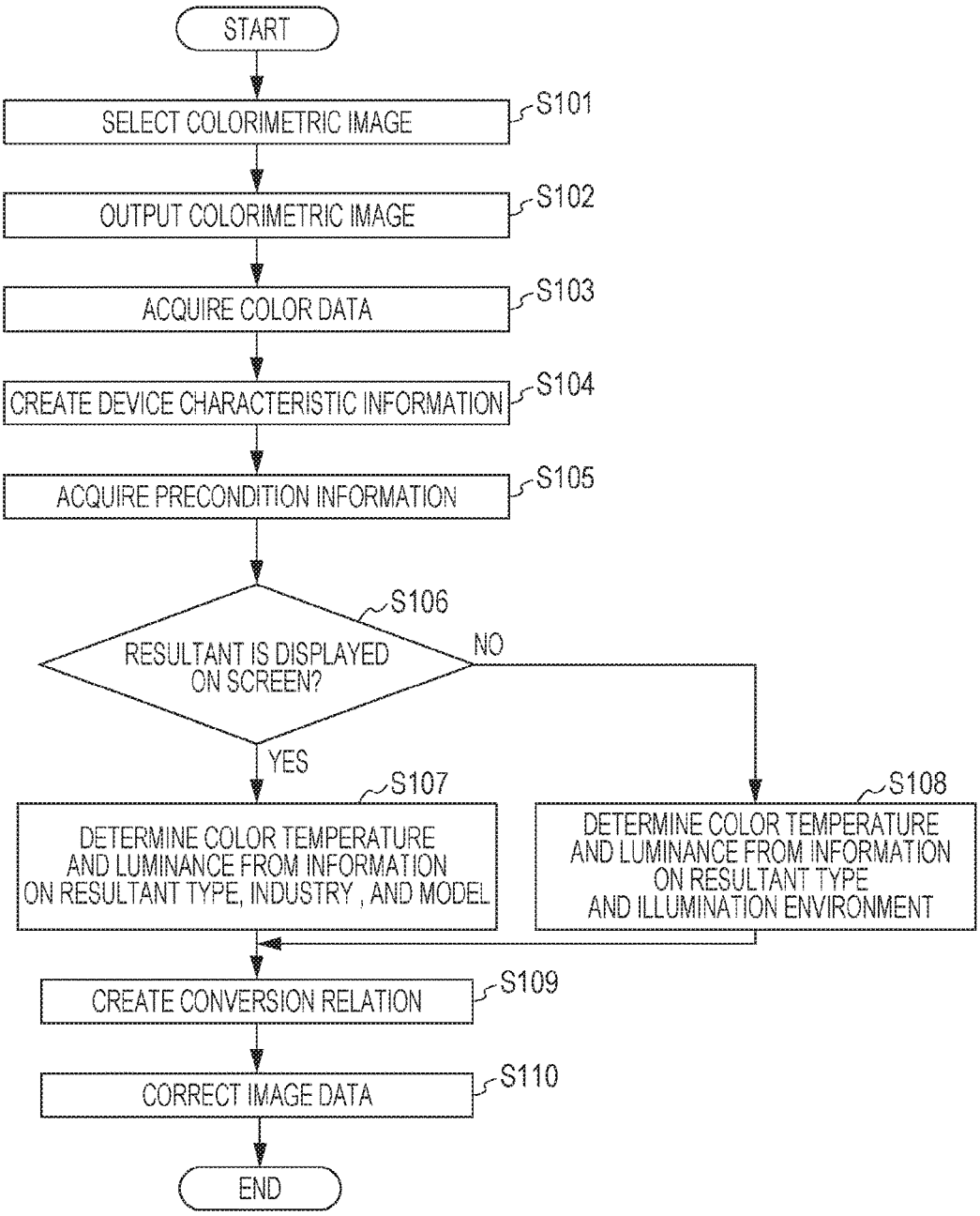
FIG. 10 is a flowchart for an operation of the computer device according to the exemplary embodiment.

FIG. 10 is a flowchart for an operation of the computer device 10 according to the exemplary embodiment. First, the colorimetric image selection unit 110 selects a colorimetric image (step 101: colorimetric image selection step).

Then, the image data transmission unit 120 outputs colorimetric image data that is image data of the colorimetric image selected by the colorimetric image selection unit 110 to the display device 20 (step 102: colorimetric image data output step). The colorimetric image data is RGB data. Hence, the colorimetric image is displayed on the display screen 21 of the display device 20. The color of the image is read by the colorimeter 50, and is transmitted as color data to the computer device 10.

Then, the color data acquisition unit 130 acquires the color data transmitted from the colorimeter 50 (step 103: color data acquisition step). The acquired color data is XYZ data.

Then, the characteristic information acquisition unit 140 creates device characteristic information that is the relation between the colorimetric image data and the color data (step 104: characteristic information acquisition step). Hence the device characteristic information is configured of a pair of the RGB data and the XYZ data ((R, G, B)-(X, Y, Z)).

The precondition information acquisition unit 150 acquires information on an environment of when a resultant (object) that is displayed as an image by the display device 20 is viewed in an actual use state, as precondition information. Also, the precondition information acquisition unit 150 acquires information on a type of resultant in addition to the information on the environment, as precondition information (step 105: environment information acquisition step). The precondition information may be input by the user by the method as described with reference to FIGS. 4A and 4B.

Then, the determination unit 160 judges whether or not the resultant is a matter that is displayed on a screen (image data such as Web design or signage) by using the information on the type of resultant included in the precondition information (step 106: judgment step).

As a result, if the resultant is a matter that is displayed on a screen (YES in step 106), the determination unit 160 determines the color temperature and luminance of the image that is displayed by the display device 20 by using the information on the type of resultant (Web design, signage, etc.), and the information on the industry and the information on the model as the information on the environment (step 107: determination step) as illustrated in FIGS. 5A and 5B. In particular, the determination unit 160 determines the color temperature by using the information on the industry relating to the resultant and the information on the type of resultant. The determination unit 160 also determines the luminance by using the information on the model. Also, at this time, the determination unit 160 may add the information on the illumination environment to determine the color temperature and luminance. The determination unit 160 may further determine intent by the method illustrated in FIGS. 6A and 6B.

In contrast, if the resultant is not a matter that is displayed on a screen (if the resultant is a real matter) (NO in step 106), the determination unit 160 determines the color temperature of an image that is displayed by the display device 20 by using the information on the type of resultant (printed matter etc.) as illustrated in FIG. 5A. The determination unit 160 also determines the luminance of the image that is displayed by the display device 20 by using the information on the illumination environment that is the information on the environment, and the information on the type of resultant with a calculation expression as follows (step 108: determination step).

$L=\rho\times E/\pi$ . . . ($L$: luminance, $E$: illuminance, $\rho$: reflectivity of object)

For the reflectivity ρ of the object, information associated with the information on the type of resultant may be held in a database, or the database may be updated with reference to the measurement result.

Then, the conversion relation creation unit 170 creates the conversion relation (profile) for performing color adjustment on the basis of the device characteristic information, and the color temperature and luminance determined by the determination unit 160 (step 109: conversion relation creation step). If the determination unit 160 further determines the expression trend (intent), the determination unit 160 creates the conversion relation by additionally using the expression trend (intent).

The color correction unit 180 corrects the image data (RGB data) to be output to the display device 20 by using the conversion relation (profile) (step 110: image data correction step).

It is difficult to perform proper color matching considering various environments in related art. For example, in the print industry, the coloring of an image that is displayed by the display device 20 is typically brought close to the coloring of a printed matter that is a resultant (object). On the other hand, in the Web industry, the coloring of Web design that is a resultant is typically brought close to the coloring of when a user views by using own display device (another display device). Therefore, the method of color matching is different depending on the industry and business practice. If a resultant is displayed on a desktop display, a large display, or a projector (another display device), the desirable luminance is different depending on the device. In this exemplary embodiment, the state when the resultant is viewed is predicted by using that the state when the resultant is viewed is substantially determined by the information on the type of resultant and the information on the environment of when the resultant is actually viewed. With regard to this, the color temperature and luminance of the image that is displayed by the display device 20 are determined. For example, the color temperature is determined by using the information on the industry and the information on the type of resultant, and the luminance is determined by using the information on the model of, for example, a desktop display, a large display, a projector, etc. (another display device). As a result, the coloring of the image of the resultant that is displayed by the display device 20 may be matched with the coloring of the actual resultant even if the type of resultant and the environment of when the resultant is viewed are different. When a designer designs the color of the resultant, the designer may recognize how the resultant actually looks.

The color processing method described above may be interpreted as a color processing method including an environment information acquisition step of acquiring information on an environment of when a resultant (object) that is displayed as an image by the display device 20 is viewed in an actual use state, and a determination step of determining the color temperature and luminance of the display device 20 on the basis of the information on the environment and information on a type of resultant (object).

Also, in the above-described exemplary embodiment, the image is displayed on the display screen 21 of the actual display device 20, and the image is measured by the colorimeter 50 to acquire the color data. However, it is not limited thereto.

Description on Program

Processing that is executed by the computer device 10 according to the exemplary embodiment described above is prepared as, for example, a program such as application software.

The processing that is executed by the computer device 10 according to the exemplary embodiment may be interpreted as a program for implementing an environment information acquisition function of acquiring information on an environment of when a resultant (object) that is displayed as an image by the display device 20 is viewed in an actual use state, and a determination function of determining the color temperature and luminance of the display device 20 on the basis of the information on the environment and information on a type of resultant (object).

The program that implements the exemplary embodiment may be of course provided by a communication measure and may be stored in a storage medium such as a CD-ROM and provided.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A color adjustment device, comprising:

at least one processor configured to execute:

an environment information acquisition unit that acquires information about an environment of when an object that is displayed as an image by a display device is viewed in an actual use state; and a determination unit that determines a color temperature and a luminance of the display device using the information about the environment and information about a type of the object, wherein the information about the environment includes information about a business practice relating to the object, and wherein the determination unit determines the color temperature by using the information about the business practice and the information about the type of the object, and determines the luminance by using information about a model of another display device.

2. The color adjustment device according to claim 1, wherein the information about the environment further includes information about an illumination environment of when the object is viewed in the actual use state.

3. The color adjustment device according to claim 1, wherein the processor is further configured to execute:

a characteristic information acquisition unit that acquires device characteristic information indicative of a relation between an input color signal to the display device and a color to be displayed; and a conversion relation creation unit that creates a conversion relation for performing color adjustment using the device characteristic information, the determined color temperature, and the determined luminance.

4. The color adjustment device according to claim 3, wherein the determination unit further determines an expression trend of the image that is displayed by the display device, and wherein the conversion relation creation unit creates the conversion relation by using the expression trend in addition to the device characteristic information, the color temperature, and the luminance.

5. The color adjustment device according to claim 1, wherein the information about the model of the another display device comprises at least one of a name of a manufacturer, a model number, and a screen size.

6. The color adjustment device according to claim 1, wherein the business practice is at least one of a print company, a product designer and an advertising agent.

7. A color processing method, comprising:

acquiring information about an environment of when an object that is displayed as an image by a display device is viewed in an actual use state; and determining a color temperature and a luminance of the display device using the information about the environment and information about a type of the object, wherein the information about the environment includes information about a business practice relating to the object, wherein the determining the color temperature comprises determining the color temperature by using the information about the business practice and the information about the type of the object, and wherein the determining the luminance comprises determining the luminance by using information about a model of another display device.

8. A non-transitory computer readable medium storing a program causing a computer to execute a process for image processing, the process comprising:

acquiring information about an environment of when an object that is displayed as an image by a display device is viewed in an actual use state; and determining a color temperature and a luminance of the display device using the information on the environment and information on a type of the object, wherein the information about the environment includes information about a business practice relating to the object, wherein the determining the color temperature comprises determining the color temperature by using the information about the business practice and the information about the type of the object, and wherein the determining the luminance comprises determining the luminance by using information about a model of another display device.

* * * * *